US005445929A

United States Patent [19]

Brown et al.

[11] Patent Number: 5,445,929

[45] Date of Patent: Aug. 29, 1995

[54] VARIABLE CONTRAST BLACK AND WHITE PHOTOGRAPHIC SYSTEM

[75] Inventors: Vincent R. Brown, Rochester; John R. Burdsall, II, Fairport, both of N.Y.

[73] Assignee: Eastman Kodak Company, Rochester, N.Y.

[21] Appl. No.: 198,685

[22] Filed: Feb. 18, 1994

Related U.S. Application Data

[63] Continuation of Ser. No. 828,332, Jan. 30, 1992, abandoned.

[51] Int. Cl.[6] ..... G03C 1/815

[52] U.S. Cl. ..... 430/511; 430/508; 430/507; 430/509; 430/510; 430/517; 430/571; 430/606

[58] Field of Search ..... 430/509, 507, 503, 571, 430/517, 510, 511, 508, 606

[56] References Cited

U.S. PATENT DOCUMENTS

| | | | |
|---|---|---|---|
| 2,202,026 | 3/1938 | Renwick | 430/503 |
| 2,280,300 | 4/1942 | Potter et al. | 95/7 |
| 4,232,116 | 11/1980 | Jamieson | 430/517 |

FOREIGN PATENT DOCUMENTS 3028167 4/1982 Germany .

*Primary Examiner*—Thorl Chea
*Attorney, Agent, or Firm*—Gordon M. Stewart

[57] ABSTRACT

There is described a photographic system comprising a variable contrast black and white photographic element and at least one filter. The element and the filter are so chosen that they cooperate to provide an extension of log exposure range of the element.

7 Claims, 2 Drawing Sheets

VARIABLE CONTRAST BLACK AND WHITE PHOTOGRAPHIC SYSTEM

CROSS REFERENCE TO RELATED APPLICATIONS

This is a Continuation of application U.S. Ser. No. 07/828,332, filed 30 Jan. 1992, now abandoned.

Copending commonly assigned U.S. patent application Ser. Nos. 774,392 of Henry et al. and 774,440 of Price et al., both filed Oct. 10, 1991 describe variable contrast photographic elements useful in the practice of this invention, and spectral sensitizing dyes and processes for sensitizing such elements.

FIELD OF THE INVENTION

This invention relates to a black and white, variable contrast photographic system. In a particular aspect, it relates to such a system having an extended log exposure range.

BACKGROUND OF THE INVENTION

When making prints from photographic negatives, it is desirable to use photographic paper which has a contrast selected to achieve satisfactory tone-reproduction of the original image based upon the contrast of the negative. Papers having higher contrasts, for example, are useful in printing negatives that themselves exhibit low contrasts, so that a satisfactory final print can be achieved. As such, photographic manufacturers offer several grades of photographic paper. In order to avoid the need for separate papers of different grades, "variable contrast" papers possessing the ability to achieve different, selected, contrasts depending upon the wavelength of exposing light have also been employed.

A useful element is described in commonly assigned copending applications of Henry et al. Ser. No. 774,392 filed Oct. 10, 1991 and Price et al. Ser. No. 774,440 filed Oct. 10, 1991. A problem with variable contrast systems employing such elements is that the contrast range that the emulsion is capable of producing has been extended to such an extent that existing filters are not able to take full advantage of the capabilities of the light sensitive element.

Accordingly, it would be desirable to provide an element/filter system that can take greater advantage of the contrast range of the improved light sensitive element.

SUMMARY OF THE INVENTION

We have found that this can be accomplished with a variable contrast black and white photographic system comprising:

a) a photographic element comprising a support bearing a silver halide emulsion layer comprising grains having native sensitivity to the region of the spectrum between about 350 and 420 nm, at least some of the grains being spectrally sensitized to the region of the spectrum between about 490 and 550 nm, and b) one or both of i) a yellow filter comprising a supported dye layer that transmits less than 1% of incident radiation in the region of the spectrum below 454 nm and ii) a purple filter comprising a supported dye layer that transmits less than 1% of incident radiation in the region of the spectrum between about 500 and 630 nm.

DETAILED DESCRIPTION

Photographic elements useful in this invention comprise a support bearing a silver halide emulsion having the spectral sensitivity characteristic described above. This can be obtained with the elements described in the commonly assigned copending Henry et al and Price et al applications described above, the disclosures of which are incorporated herein by reference, or by other elements comprising silver halide emulsions and/or sensitizing dyes and/or layer arrangement that provide equivalent results.

Preferred elements are comprised of silver chlorobromide emulsions so sensitized that they have a log exposure range of between about 0.50 and 0.60 when exposed only to radiation below 420 nm and a log exposure range of between about 1.60 and 2.20 when exposed only to radiation above about 490 nm.

The filters that form a part of the novel system of this invention would be used at the extreme ends of existing filter sets to permit an extension of the log exposure range obtainable with the light sensitive material described above.

Figure 1:
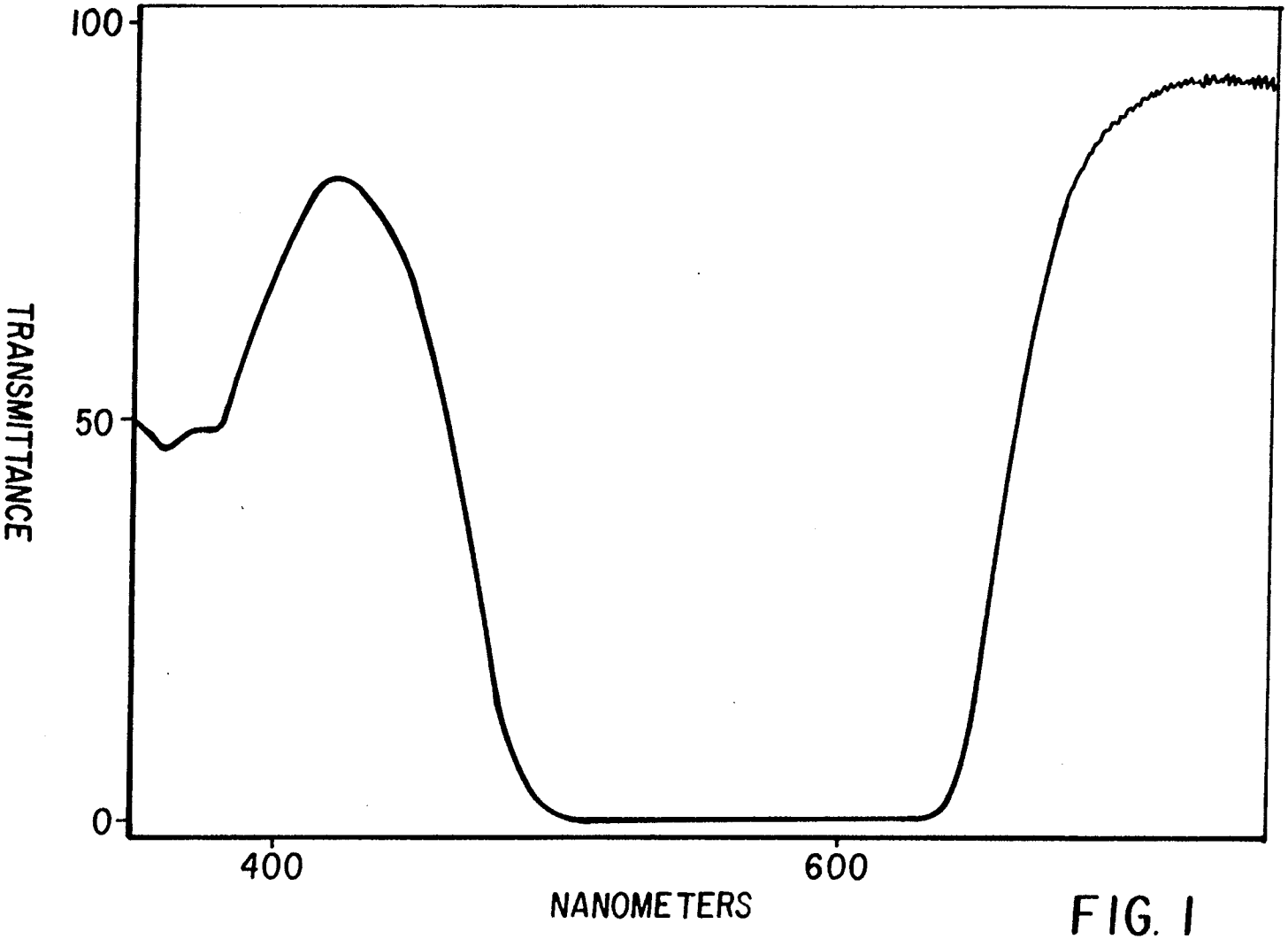
Figure 2:
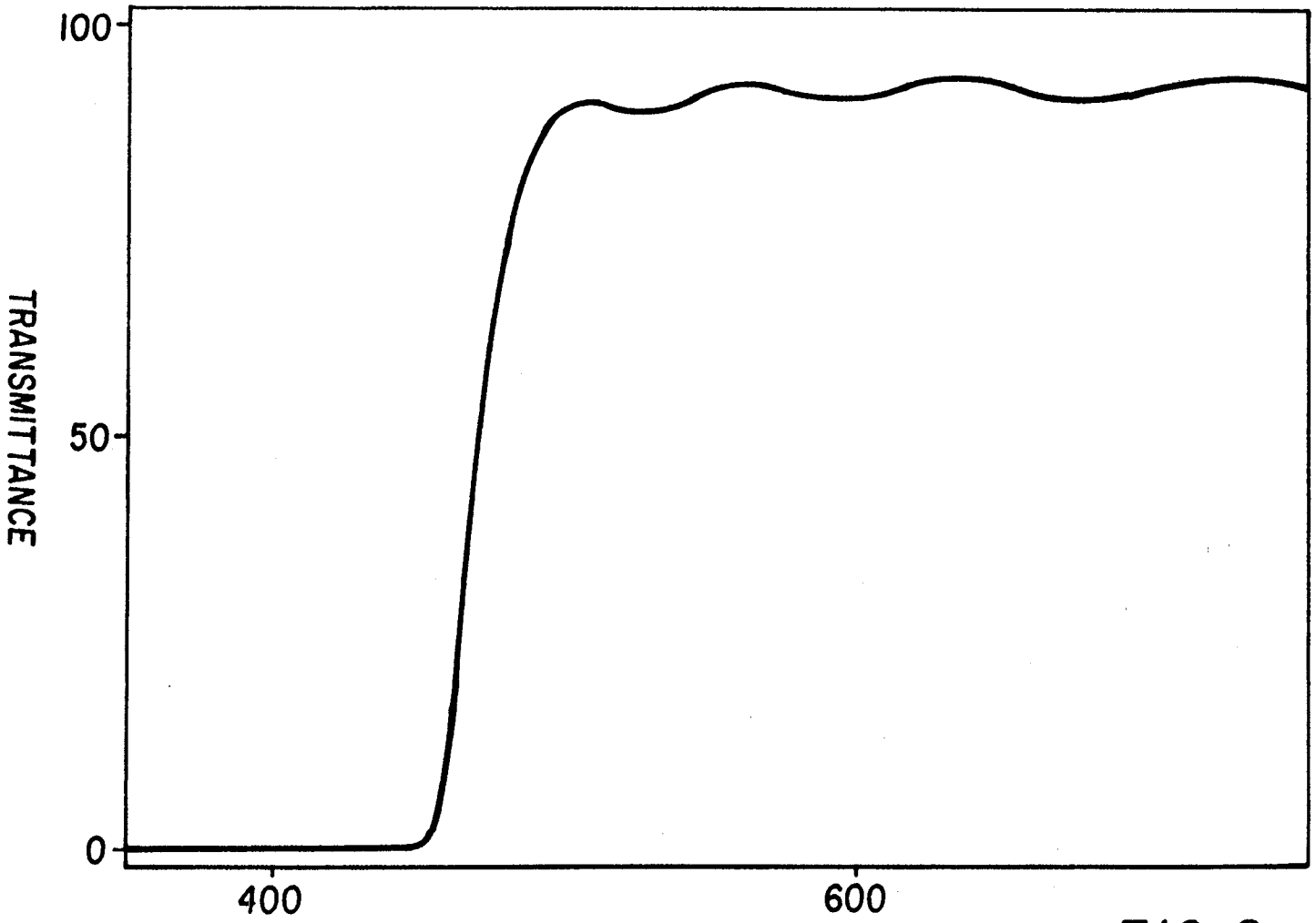

Preferred filters have the spectral transmittance characteristics shown in FIGS. 1 and 2, in which FIG. 1 is a plot of transmittance vs. wavelength in nm for a preferred purple filter and FIG. 2 is a similar plot for a preferred yellow filter.

Purple filters having the spectral absorption characteristics of FIG. 1 can be obtained with a mixture of the following dyes in suitable proportions: 3H-Indolium, 1-ethyl-2-y3-(1-ethyl-1,3-dihydro-3,3-dimethyl-2H-indol-2-ylidene)-1-propenyl''-3,3-dimethyl-, salt with 4-methylbenzenesulfonic acid (1:1) and crystal violet.

Yellow filters having the spectral absorption characteristics shown in FIG. 2 can be obtained with benzoic acid, 4-hydrazino-, dihydrazone with arabino-hexos-2-ulose (9CI).

The yellow spectral absorption characteristics can be provided by a filter like a Wratten 4 filter and the purple spectral absorption characteristics described above can be provided by a filter like a Wratten 34 filter. To optimize the Wratten 4 and 34 filters for use in this system, their density can be adjusted so as to give transmittance values like that shown in FIGS. 1 and 2 so that the exposure times with these filters are in the same approximate exposure range as are used with existing filters for light sensitive elements of this type.

Processing to form a visible image includes the step of contacting an imagewise exposed element with a black and white developing agent to reduce developable silver halide to metallic silver. The developing agent is preferably contained in a developer bath, although a part or all of it could be contained in the light sensitive element and the element activated to make the developing agent available by contacting the element with an aqueous alkaline solution. Development is followed by the conventional steps of fixing to remove undeveloped silver halide, washing and drying. In some instances, as an alternative to fixing it is possible to render remaining silver halide non-light sensitive by treatment with a suitable stabilizer bath.

EXAMPLE

A photographic element is prepared comprising a silver chlorobromide (50 mol % Cl) emulsion of cubic morphology with edgelength equal to 0.47 microns chemically sensitized with sulfur-plus-gold and spectrally sensitized with a green spectral sensitizing dye having the structure

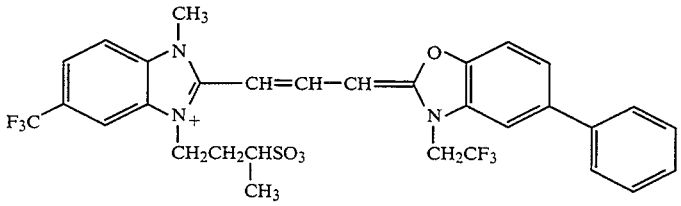

at the ratio of 0.019 mmol/Ag mol. The emulsion is coated, with suitable addenda, on a polyethylene coated paper support at a coverage of 12.96 Ag mmol per sq. m.

Separate samples of this element are exposed thru individual ones of the filters having the spectral transmittance characteristics shown in FIGS. 1 and 2, as well as thru KODAK POLYCONTRAST II 5 and 0 filters. The exposed elements were processed for 60 seconds at 20 degrees C. in KODAK DEKTOL black and white paper developer, stopped, fixed, washed, and dried. Log Exposure Range (LER) for the pair of KODAK POLYCONTRAST II 5 and 0 filters and for the pair of filters of FIGS. 1 and 2 was measured as described in ANSI/ACS Standard 2.2-1984. (It will be appreciated by those skilled in the art that departure form the exposure conditions given in the standard or the processing conditions specified above, may result in variation of these LERs.) The LER of the element when exposed with the KODAK POLYCONTRAST II 5 filter is 0.73 and when exposed with the KODAK POLYCONTRAST II 0 filter is 1.41, while the LER of the element when exposed with the filter of FIG. 1 is 0.56 and when exposed to the filter of FIG. 2 is 1.68. This represents an increase in the extent of the LER that can be obtained from a net range of 0.68 with the prior art system to a net range of 1.12 with the system of this invention.

The invention has been described in detail with particular reference to preferred embodiments thereof, but it will be understood that variations and modifications can be effected within the spirit and scope of the invention.

What is claimed is:

1. A variable contrast black and white photographic system comprising:

a) a photographic element comprising a support bearing a silver halide emulsion layer comprising grains having native sensitivity to the region of the spectrum between about 350 and 420 nm, at least some of the grains being spectrally sensitized to the region of the spectrum between about 490 and 550 nm, and b) a yellow filter comprising a supported dye layer that transmits less than 1% of incident radiation in the region of the spectrum below about 454 nm.

2. A variable contrast black and white photographic system comprising:

a) a photographic element comprising a support bearing a silver halide emulsion layer comprising grains having native sensitivity to the region of the spectrum between about 350 and 420 nm, at least some of the grains being spectrally sensitized to the region of the spectrum between about 490 and 550 nm, and b) a purple filter comprising a supported dye layer that transmits less than 1% of incident radiation in the region of the spectrum between about 500 and 630 nm.

3. A variable contrast black and white photographic system comprising:

a) a photographic element comprising a support bearing a silver halide emulsion layer comprising grains having native sensitivity to the region of the spectrum between about 350 and 420 nm, at least some of the grains being spectrally sensitized to the region of the spectrum between about 490 and 550 nm, and b) a filter combination comprising i) a yellow filter comprising a supported dye layer that transmits less than 1% of incident radiation in the region of the spectrum below 454 nm and ii) a purple filter comprising a supported dye layer that transmits less than 1% of incident radiation in the region of the spectrum between about 500 and 630 nm.

4. A variable contrast black and white photographic system of claims 1 or 2 wherein the silver halide emulsion is comprised of silver chlorobromide grains.

5. A variable contrast black and white photographic system of claim 4 wherein the emulsion has a log exposure range of between about 0.50 and 0.60 when exposed only to radiation below 420 nm.

6. A variable contrast black and white photographic system of claim 4 wherein the emulsion has a log exposure range of between about 1.60 and 2.20 when exposed only to radiation above about 490 nm.

7. A variable contrast black and white photographic system of claim 3 wherein the system has a net log exposure range of between about 1.0 and 1.7.

* * * * *